US007435122B2

(12) United States Patent
Suzuki et al.

(10) Patent No.: US 7,435,122 B2
(45) Date of Patent: Oct. 14, 2008

(54) CONNECTOR

(75) Inventors: Masayuki Suzuki, Koto-ku (JP); Yasuyuki Koguchi, Koto-ku (JP)

(73) Assignee: DDK Ltd., Tokyo (JP)

( * ) Notice: Subject to any disclaimer, the term of this patent is extended or adjusted under 35 U.S.C. 154(b) by 435 days.

(21) Appl. No.: 11/231,519

(22) Filed: Sep. 21, 2005

(65) Prior Publication Data

US 2006/0084311 A1 Apr. 20, 2006

(30) Foreign Application Priority Data

Oct. 18, 2004 (JP) ..... 2004-303035

(51) Int. Cl.
*H01R 13/15* (2006.01)

(52) U.S. Cl. ..... 439/260

(58) Field of Classification Search ..... 439/260, 439/259, 492–499

See application file for complete search history.

(56) References Cited

U.S. PATENT DOCUMENTS

| | | | | |
|---|---|---|---|---|
| 4,808,113 | A | 2/1989 | Kanesige et al. | |
| 5,906,498 | A | 5/1999 | Nagafuji | |
| 5,928,029 | A | 7/1999 | Lam | |
| 6,056,572 | A | 5/2000 | Matsumoto et al. | |
| 6,471,541 | B2 | 10/2002 | Kunishi et al. | |
| 6,726,497 | B2 * | 4/2004 | Nogawa et al. | 439/260 |
| 6,755,682 | B2 | 6/2004 | Kunishi et al. | |
| 6,837,740 | B2 * | 1/2005 | Kunishi et al. | 439/495 |
| 7,083,454 | B2 * | 8/2006 | Suzuki | 439/260 |
| 7,137,838 | B2 * | 11/2006 | Koga | 439/260 |
| 7,140,896 | B2 * | 11/2006 | Takai et al. | 439/260 |
| 7,147,498 | B1 * | 12/2006 | Gillespie et al. | 439/260 |
| 7,223,110 | B2 * | 5/2007 | Suzuki et al. | 439/260 |
| 7,255,584 | B2 * | 8/2007 | Takashita | 438/260 |
| 7,261,588 | B2 * | 8/2007 | Yokoyama | 439/495 |
| 7,275,948 | B2 * | 10/2007 | Miura et al. | 439/260 |
| 7,300,304 | B1 * | 11/2007 | Takashita | 439/495 |
| 2006/0084311 | A1 * | 4/2006 | Suzuki et al. | 439/260 |
| 2006/0089036 | A1 * | 4/2006 | Takai et al. | 439/260 |

FOREIGN PATENT DOCUMENTS

| | | |
|---|---|---|
| JP | 59-086679 | 5/1984 |
| JP | 60-57083 | 4/1985 |
| JP | 2-502771 | 9/1990 |
| JP | H3-8886 | 1/1991 |
| JP | H3-103578 | 10/1991 |

(Continued)

*Primary Examiner*—Alexander Gilman
(74) *Attorney, Agent, or Firm*—Baker Botts LLP

(57) ABSTRACT

Contacts each include a first piece having a contact portion extensible into a fitting opening of a housing to contact a connecting object and a pressure receiving portion urged by a pivoting member, a second piece having a fulcrum portion and a connection portion connected to a substrate, a connecting portion connecting the first piece and the fulcrum portion, and a second pressure receiving portion substantially L-shaped extending from the connecting portion. The contact portion, connecting portion, fulcrum portion and connection portion are arranged substantially in a crank. The pivoting member is pivotally movable on the housing so that urging portions are pivotally movable between the pressure receiving portions and the second pressure receiving portions. Even there is an operating space only on the fitting opening side, the pivoting member being operatable, and a ZIF construction and upper and lower contact portions are possible.

24 Claims, 7 Drawing Sheets

FOREIGN PATENT DOCUMENTS

| | | |
|---|---|---|
| JP | 51-82729 | 7/1993 |
| JP | 05-217642 | 8/1993 |
| JP | H5-84071 | 11/1993 |
| JP | 06-176826 | 6/1994 |
| JP | 06-86289 | 12/1994 |
| JP | 70-16381 | 1/1995 |
| JP | 70-016385 | 1/1995 |
| JP | 08-180940 | 7/1996 |
| JP | 82-50212 | 9/1996 |
| JP | 3035692 | 1/1997 |
| JP | 09-171858 | 6/1997 |
| JP | 09-199241 | 7/1997 |
| JP | 10-125415 | 5/1998 |
| JP | 10-208810 | 8/1998 |
| JP | 11-031561 | 2/1999 |
| JP | 11-054220 | 2/1999 |
| JP | H11-307198/1999 | 11/1999 |
| JP | 2000-021478 | 1/2000 |
| JP | 2000-030784 | 1/2000 |
| JP | 2000-106238 | 4/2000 |
| JP | 2000-299168 | 10/2000 |
| JP | 2001-307805 | 11/2001 |
| JP | 2001-345136 | 12/2001 |
| JP | 2001-357918 | 12/2001 |
| JP | 2002-015800 | 1/2002 |
| JP | 002-042980 | 2/2002 |
| JP | 2002-042939 | 2/2002 |
| JP | 2002-073081 | 3/2002 |
| JP | 2002-093526 | 3/2002 |
| JP | 2002-134194 | 5/2002 |
| JP | 2002-190360 | 7/2002 |
| JP | 2002-270290 | 9/2002 |
| JP | 2003-151662 | 5/2003 |
| JP | 2003-297489 | 10/2003 |
| JP | 2004-071160 | 3/2004 |
| JP | 2004-71160 | 3/2004 |
| JP | 2004-178958 | 6/2004 |
| JP | 2004-178959 | 6/2004 |
| JP | 2004-206987 | 7/2004 |
| JP | 2004-214124 | 7/2004 |
| JP | 2005-069882 | 3/2005 |
| JP | 3903338 | 1/2007 |

* cited by examiner

CONNECTOR

CROSS-REFERENCE TO RELATED APPLICATIONS

This application claims priority from Japanese Patent Application No. 2004-303,035, filed Oct. 18, 2004, which is incorporated by reference in its entirety.

BACKGROUND OF THE INVENTION

The present invention relates to a connector for use in mobile phones or cellular phones, notebook personal computers, digital cameras or the like, and more particularly to a connector enabling stable electrical connection to a connecting object such as a flexible printed circuit board or flexible flat cable.

Connectors for use in mobile phones, CCD cameras (charge coupled device cameras) and the like are very thin in overall height and have extremely narrow pitches (so-called lighter and more compact). These connectors each mainly comprise a housing, contacts and a slider to embrace a flexible printed circuit board or flexible flat cable between the housing and the slider. Various methods may be envisioned for embracing a circuit board or flat cable between the housing and the slider. There have been used constructions in many cases that after a flexible printed circuit board or flat cable has been inserted into the housing, the slider is inserted into the housing to press the circuit board or cable against the contacts.

In recent years, moreover, connectors using a pivoting member instead of the slider are increasingly being used to bring contacts into contact with a connecting object such as a flexible circuit board. Among these connectors, one type of which is to pivotally move a pivoting member on the side of insertion of a connecting object (front pivoting type), and the other type is to pivotally move a pivoting member on the opposite side of insertion of a connecting object (rear pivoting type).

The connector of the front pivoting type has been disclosed in Japanese Patent Application Opened No. 2000-106,238 (Patent Literature 1). The connectors of the rear pivoting type have been disclosed in Japanese Patent Application Opened No. 2003-297,489 (Patent Literature 2), Japanese Patent Application No. H11-307,198/1999 (Patent Literature 3), and Japanese Patent Application Opened No. 2004-71,160 (Patent Literature 4).

Patent Literature 1

According to the Abstract of the Japanese Patent Application Opened No. 2000-106,238, this invention has an object to provide a connector for a cable, which requires only a slight operating force even if there are very many conductors of the cable. Disclosed in the Patent Literature 1 is a connector for a cable comprising contacts each having a contact portion facing to one surface of a cable and a pivot portion facing to the rear surface of the cable, and an actuating element adapted to press the cable against the contact portions of the contacts and having cam portions positioned between the pivot portions and the cable and holes into which inserted with clearances are the pivot portions, the pivot portions each having a recess corresponding to the cam portion so that the actuating element is adapted to engage the pivot portions in a manner that the actuating element is pivotally movable about the cam portions. By the way, claim 1 of the Japanese Patent Application Opened No. 2000-106,238 recites that in a connector including contacts each having a contact portion facing to one surface of said cable and a pivot portion facing to the opposite surface of the cable, an insulator for holding said contacts and an actuating element for pressing the cable against the contact portions of said contacts, said actuating element includes cam portions positioned between the pivot portions and the cable and holes into which inserted with clearances are pivot portions, and said pivot portions each having a recess corresponding to said cam portion so that said actuating element is adapted to engage the pivot portions in a manner that the actuating element is pivotally movable about the cam portions. Claim 2 recites that said insulator includes anchoring portions adapted to engage said actuating elements to hold said actuating element in a manner that said cam portions are spaced from said contact portions of the contacts when the cable has not been connected to the connector. Claim 3 recites that said cable is a flat cable, and said insulator include a cable anchoring groove for preventing the cable from moving in the direction progressively becoming thicker by receiving a side edge of the cable in the cable anchoring groove when the cable has been connected to the connector. Claim 4 recites that in a connector obtaining electrical connection between contacts and a cable in a manner that the surface of the cable on the opposite side of its surface facing to the contact portions of the contacts is urged against the contact portions by the rotational actuating element, said contact portions each provided with at least two contact side projections, while said actuating element is provided with actuating element side projections corresponding to spaces between said contact side projections. Claim 5 recites the connector including said contacts each having a pivot portion facing to the opposite surface of the cable and said actuating element having cam portions between the pivot portions and the cable, said cam portions each provided with said actuating element side projection.

Patent Literature 2

According to the Abstract of the Japanese Patent Application Opened No. 2003-297,489, this invention has an object to provide a connector of miniaturization in height or reduced overall height including an actuator to be operated by only a slight operating force and enabling contacts to move large distances to perform reliable connection of the contacts. The actuator includes cam portions and an actuating portion, and the actuator is formed between the cam portions and the actuating portion with relief grooves into and from which the forward ends of spring portions of the contacts are inserted and removed for the purpose of obtaining a further reduced overall height connector. When the actuator is rotated clockwise about its fulcrum point through 90 degrees, the cam portions cause the spring portions and connection spring portions to be elastically deformed, thereby embracing the flexible circuit board between projections of the contact portions of the contacts to achieve electrical connection between patterns of the circuit board and a printed board through terminals of the contacts. A ceiling portion of an insulator or housing covers the contact portions of the contacts, and the lower portion under the ceiling portion on the front side is formed with a guide for inserting the circuit board into the connector. By the way, the claim 1 of the Japanese Patent Application Opened No. 2003-297,489 recites that in a connector including contacts, an insulator for holding the contacts, and an actuator rotatably mounted on the insulator and causing the contacts to be elastically deformed to bring them into contact with a connecting object, the contacts each consist of a first beam having a contact portion at its one end adapted to contact the connecting object and an actuated portion at the other end adapted to be actuated by the actuator, a second beam having a contact portion at its one end adapted to contact the connecting object and a terminal at the other end to be connected to a printed substrate, and a connecting spring for connecting the first and second beams, and said insulator has a ceiling portion for covering at least the contact portions of the contacts on the fitting side and said ceiling portion formed with a guide for guiding the insertion of the connecting object. Claim 2 recites a connector of the contacts each of which has at least one contact portion having in the proximity of the connecting spring an inclined portion inclining toward the connecting object. Claim 3 recites a connector of the actuator having an actuating portion, cam portions for actuating the actuated portions of the contacts, and relief groves positioned between the actuating portion and the cam portions so that in the state that the connecting object is not connected to the connector, the actuated portions can be inserted into the relief grooves. Claim 4 recites that in a connector including contacts, an insulator holding the contacts, and an actuator rotatably mounted on the insulator and causing the contacts to be elastically deformed to bring them into contact with a connecting object, said contacts each consist of a first beam having a contact portion at its one end adapted to contact the connecting object and an actuated portion at the other end adapted to be actuated by the actuator, a second beam having a contact portion at its one end adapted to contact the connecting object and a terminal at the other end to be connected to a printed substrate, and a connecting spring for connecting the first and second beams, said contact portion of the first beam having a first projection and a second projection extending toward the connecting object and arranged side by side in the inserting direction of the connecting object, and said contact portion of the second beam having a third projection and a fourth projection extending toward the connecting object and arranged side by side in the inserting direction of the connecting object, so that depending upon the third projection being positioned between the first and second projections or the first projection being positioned between the third and fourth projections, the first and second projections or the third and fourth projections come into contact with the connecting object.

Patent Literature 3

According to the Abstract of Japanese Patent Application Opened No. H11-307,198/1999, this invention has an object to improve operationality and holding power of a connector connecting a plurality of terminals and holding a flexible printed circuit board and the like. The disclosed connector for a printed circuit board includes a housing formed with inserting groove for inserting the flexible printed circuit board, a plurality of contacts provided side by side whose contact portions are arranged to extend and retract relative to the inserting groove, and an actuating member arranged pivotally movably between a connecting and a disconnecting position. The actuating member is provided with a plurality of cams so that when the actuating member is in the connecting position, contacts are urged with their actuated portions by the cams to extend their contact portions into the inserting groove thereby enabling the contact portions to be pressed against and connected to terminals of the flexible printed circuit board and holding the circuit board. While when the actuating member is in the disconnecting position, some contacts are urged with their actuated portions by the cams to slightly extend their contact portions into the inserting groove so as to abut against the flexible printed circuit board, thereby temporarily holding the circuit board, while the contact portions of the remaining contacts are retracted from the inserting groove. By the way, claim 1 of the Japanese Patent Application Opened No. H11-307,198/1999 recites that in a connector for a printed circuit board, provided with a plurality of contacts arranged side by side for connecting a plurality of terminals of a printed circuit board or the like in the lump, said connector comprises a housing having an inserting groove for inserting the printed circuit board or the like, said contacts arranged to extend and retract relative to said inserting groove, and an actuating member provided movably between a connecting and a disconnecting position, and when the actuating member is in the connecting position, the contacts are urged by the actuating member so as to extend into the inserting groove to press the terminals of the flexible printed circuit board or the like so that the contacts are connected to the terminals and hold the printed circuit board or the like, and when the actuating member is in the disconnecting position, the some of the contacts extend slightly into the inserting groove to abut against and temporarily hold the printed circuit board or the like, and the remaining contacts retract relative to the inserting groove. Claim 2 recites a connector for a printed circuit board in that the plurality of the contacts are formed in the same shape and the actuating member is provided with a plurality of cams, and when the actuating member is in the connecting position, the contacts are urged by the cams to extend into the inserting groove, and when the actuating member is in the disconnecting position, the some contacts are urged by the cams to slightly extend into the inserting groove and the remaining contacts are retracted relative to the inserting groove.

Patent Literature 4

According to the Abstract of the Japanese Patent Application Opened No. 2004-71,160, this invention has an object to provide a connector capable of securely urging a flexible printed circuit board or flexible flat cable to contact portions of contacts with the aid of a slider without degrading strength of respective members and specifications or customers demands, and capable of being used with high operationality and fully complying with requirements such as narrower pitches of conductors and miniaturization in height or reduced overall height. This connector comprises contacts each comprising a contact portion, a connection portion, and an elastic portion and a fulcrum portion between the contact portion and the connection portion, and a pressure receiving portion extending from the elastic portion in a position facing to the connection portion, and the contact portion, elastic portion, fulcrum portion and connection portion being arranged in the form of a crank, and a slider comprising urging portions arranged continuously in the longitudinal direction and pivotally mounted on a housing so that the urging portions are pivotally moved in a space between the connection portions and pressure receiving portions of the contacts. Claim 1 of the Japanese Patent Application Opened No. 2004-71,160 recites a connector removably fitted with a flexible printed circuit board or flexible flat cable, including a required number of contacts having a contact portion adapted to contact said flexible printed circuit board or flexible flat cable, a housing holding and fixing the contacts and having an inserting opening for inserting the flexible printed circuit board or flexible flat cable, and a slider for urging the flexible printed circuit board or flexible flat cable to the contacts, wherein the contacts each comprise an elastic portion and a fulcrum portion between the contact portion and a connection portion, and a pressure receiving portion extending from the elastic portion and located in a position facing to the connection portion, and the connection portion, elastic portion, fulcrum portion and connection portion being arranged substantially in the form of a crank, and the slider is provided with urging portions continuously arranged in its longitudinal direction and is mounted on the housing so that the urging portions are pivotally moved in a space between the connection portions and pressure receiving portions of the contacts. Claim 2 recites a connector removably fitted with a flexible printed circuit board or flexible flat cable, including a required number of contacts having a contact portion adapted to contact said flexible printed circuit board or flexible flat cable, a housing holding and fixing the contacts and having an inserting opening for inserting the flexible printed circuit board or flexible flat cable, and a slider for urging the flexible printed circuit board or flexible flat cable to the contacts, wherein two kinds of contacts are arranged alternately staggered, the contacts of one kind each comprising an elastic portion and a fulcrum portion between the contact portion and a connection portion, and a pressure receiving portion extending from the elastic portion in a position facing to the connection portion, and the contact portion, elastic portion, fulcrum portion and connection portion being arranged substantially in the form of a crank, and the contacts of the other kind each comprising an elastic portion and a fulcrum portion between the contact portion and a connection portion, and a pressure receiving portion extending in the opposite direction of the contact portion, and the contact portion, elastic portion, fulcrum portion, and connection portion being arranged substantially in the form of a U-shape, and the slider is provided with urging portions arranged continuously in its longitudinal direction and mounted on the housing so that the urging portions are pivotally moved in a space between the connection portions and the pressure receiving portions of the contacts of the one kind and between the pressure receiving portions and the housing of the contacts of the other kind. Claim 3 recites that when the urging portions of the slider are pivotally moved in the space between the connection portions and the pressure receiving portions of the contacts of the one kind, the pressure receiving portions are raised by the urging portions so that the elastic portions are tilted about the fulcrum portions toward the contact portions to urge the contact portions against the flexible printed circuit board or flexible flat cable. Claim 4 recites that the pressure receiving portions of the contacts of the one kind or the other kind are each provided with a projection so that the urging portions of the slider are prevented from moving toward the connection portions of the contacts of the one kind. Claim 5 recites that the urging portions of the slider are of an elongated shape. Claim 6 recites that the slider is formed with a required number of anchoring grooves independent from one another, which are adapted to engage the projections of the contacts, respectively. Claim 7 recites the elongated urging portions being in the form of an ellipsoid. Claim 8 recites a connector of contacts each provided with a further contact portion at a location extending from the fulcrum portion and adapted to contact the flexible printed circuit board or flexible flat cable. Claim 9 recites that the contacts of the other kind are each provided with an extension portion extending from the fulcrum in the opposite direction of the connection portion, and the slider is mounted on the housing so that the urging portions of the slider are pivotally moved in the space between the extension portions and the pressure receiving portions. Claim 10 recites a connector of the contacts of the other kind each provided between the fulcrum portion and the connection portion with a contact portion adapted to contact the flexible printed circuit board or flexible flat cable.

In recent years, depending upon applications and operating direction of pivoting members, it may be determined to use either the front pivoting type connectors such as disclosed in the Patent Literature 1 or the rear pivoting type connectors disclosed in the Patent Literatures 2 to 4.

In the case that there is a space for operating a pivoting member only on the side where a connecting object is inserted into the connector, connectors to be used would be limited to the front pivoting type connectors as disclosed in the Patent Literature 1 so that positions of contacts to be connected to a connecting object would be limited to the lower side of the connector. In the case that the space for a pivoting member has been already determined (for mobile phones or digital cameras), however, there is requirement for contacts arranged on upper and lower sides of a connector, which may be possible in rear pivoting type connectors. In recent years, moreover, the requirement for more miniaturization in height or reduced overall height of connectors has become stronger.

SUMMARY OF THE INVENTION

It is an object of the invention to provide an improved connector which eliminates all the disadvantages of the prior art described above and which enables a ZIF (zero-insertion force) structure or LIF (low-insertion force) structure and is also capable of arranging contacts on upper and lower sides, thereby obtaining stable electrical connection between a connecting object and the connector.

The above object will be achieved by the connector 10 according to the invention including a plurality of contacts 14 having at least one contact portion 26 adapted to contact a connecting object, a housing 12 for arranging and holding the contacts 14, the housing having a fitting opening 17 into which the connecting object is inserted, and a pivoting member 16 for causing the contacts 14 to be elastically deformed, wherein the contacts 14 each comprise a first piece 22 having the contact portion 26 at one end adapted to contact the connecting object and a pressure receiving portion 32 at the other end adapted to be urged by the pivoting member 16; a second piece 24 having a fulcrum portion 28 at one end and a connection portion 40 at the other end adapted to be connected to a substrate 20; a jointing portion or a connecting portion 30 for connecting the first piece 22 and the fulcrum portion 28; and a second pressure receiving portion 34 substantially in the form of an L-shape extending between the connection portion 40 and the fulcrum portion 28; and the contact portion 26, the connecting portion 30, the fulcrum portion 28 and the connection portion 40 are arranged substantially in the form of a crank, and the contact portions 26 are adapted to extend into the fitting opening 17, wherein the pivoting member 16 comprises an actuating portion 48 for pivotally moving the pivoting member, urging portions 46 continuously arranged in the longitudinal direction of the pivoting member, and anchoring holes 50 each for receiving therein the second pressure receiving portion 34, and the pivoting member is mounted on the housing 12 so that the urging portions 46 are pivotally moved between the pressure receiving portions 32 and the second pressure receiving portions 34 of the contacts 14, and wherein when the connecting object and the connector 10 have not been connected (or the pivoting member 16 being in an opened position), the urging portions 46 are pivotally movable between the pressure receiving portions 32 and the second pressure receiving portions 34 so that the pressure receiving portions 32 are urged to raise the contact portions 26 in a direction retracting from the fitting opening, and when the connecting object and the connector 10 have been connected (or the pivoting member 16 in a closed position), the contact portions 26 of the contacts 14 extend into the fitting opening 17 to come into contact with the connecting object.

Even narrower pitches of contacts will be accomplished by the connector 10 according to the invention including a plurality of contacts 14 having at least one contact portion 26 adapted to contact a connecting object, a housing 12 for arranging and holding the contacts, the housing having a fitting opening 17 into which the connecting object is inserted, and a pivoting member 16 for causing the contacts 14 to be elastically deformed, wherein the contacts consist of two kinds of contacts 14, 141 arranged alternately staggered, wherein the contacts 14 of the one kind each comprise a first piece 22 having the contact portion 26 at one end adapted to contact the connecting object and a pressure receiving portion 32 at the other end adapted to be urged by the pivoting member 16; a second piece 24 having a fulcrum portion 28 at one end and a connection portion 40 at the other end adapted to be connected to a substrate 20; a connecting portion 30 for connecting the first piece 22 and the fulcrum portion 28; and a second pressure receiving portion 34 substantially in the form of an L-shape extending between the connection portion 40 and the fulcrum portion 28; and the contact portion 26, the connecting portion 30, the fulcrum portion 28 and the connection portion 40 are arranged substantially in the form of a crank, and the contact portions 26 are adapted to extend into the fitting opening 17, wherein the contacts 141 of the other kind each comprises a first piece 22 having the contact portion 26 at one end adapted to contact the connecting object and a pressure receiving portion 32 at the other end adapted to be urged by the pivoting member 16; a second piece 24 having a connection portion 40 at one end adapted to be connected to a substrate 20 and a fulcrum portion 28 at the other end; a connecting portion 30 for connecting the first piece 22 and the fulcrum portion 28; and a second pressure receiving portion 34 substantially in the form of a U-shape extending from the fulcrum portion 28; and the contact portion 26, the connecting portion 30, the fulcrum portion 28 and the connection portion 40 are arranged substantially in the form of a U-shape, and the contact portions 26 are adapted to extend into the fitting opening 17, wherein the pivoting member 16 comprises an actuating portion 48 for pivotally moving the pivoting member, urging portions 46 continuously arranged in the longitudinal direction of the pivoting member, and anchoring holes 50 each for receiving therein the second pressure receiving portion 34, and the pivoting member 16 is mounted on the housing 12 so that the urging portions 46 are pivotally moved between the pressure receiving portions 32 and the second pressure receiving portions 34 of the contacts 14, 141 of the first and second kinds, and wherein when the connecting object and the connector 10 have not been connected (or the pivoting member 16 being in an opened position), the urging portions 46 are pivotally movable between the pressure receiving portions 32 and the second pressure receiving portions 34 so that the pressure receiving portions 32 are urged to raise the contact portions 26 in a direction retracting from the fitting opening, and when the connecting object and the connector 10 have been connected (or the pivoting member 16 in a closed position), the contact portions 26 of the contacts 14, 141 extend into the fitting opening 17 to come into contact with the connecting object.

Preferably, the contacts each further comprise an extension portion 36 extending from the fulcrum portion 28 in such a direction that the extension portion 36 faces to the contact portion 26 of the first piece, and a further contact portion 26 located in a position facing to the contact portion 26 of the first piece and at a distal end of the extension portion 36. Moreover, the contacts each further comprise a further contact portion 26 in a position facing to the contact portion 26 of the first piece and between the connection portion 40 and the fulcrum portion 28.

In a preferred embodiment, there is provided a projection 42 extending from and located at a tip of either or both of the pressure receiving portion 32 and the second pressure receiving portion 34 of each of the contacts, and the urging portions 46 are pivotally movable between the pressure receiving portions 32 and the second pressure receiving portions 34. Moreover, the pressure receiving portion 32 and the second receiving portion 34 of each of the contacts are substantially in parallel with each other so that the urging portion 46 of the pivoting member is pivotally movable between the pressure receiving portion 32 and the second pressure receiving portion 34.

Preferably, the second pressure receiving portion 34 of each of the contacts is formed with a recess 41 on the inner side of the projection 42 so that the urging portion 46 is pivotally movable in the recess 41 and between the pressure receiving portion 32 and the second pressure receiving portion 34. Further, when the connecting object has been inserted into the connector, each of the urging portions 46 lies in the recess 41 of the second pressure receiving portion 34 of each of the contacts. The anchoring holes 50 of the pivoting member 16 are preferably independent from one another.

In a preferred embodiment, the housing 12 is provided at both the longitudinal ends with upper walls 55 partly forming the fitting opening 17. Moreover, the connecting object is provided at both the longitudinal ends with anchoring portions 54, and the pivoting member 16 is provided with engaging portions 51 which are located at positions corresponding to and engaged with the anchoring portions 54 when the connecting object has been inserted into the connector.

Preferably, a hard substrate 20 is formed with a notch 52, and the connector 10 is connected to the hard substrate in a manner that the connector is accommodated in the notch 52 of the hard substrate.

The connector according to the invention has a following function. When an connecting object such as a flexible printed circuit board 18 or flat cable is inserted into the fitting opening 17 of the housing 12 of the connector, the urging portions 46 of the pivoting member 16 are pivotally moved between the pressure receiving portions 32 and the second pressure receiving portions 34 of the contacts 14 so that the urging portions 46 urge the pressure receiving portions 32 downwardly, with the result that the contact portions 26 of the contacts 14 are raised about the fulcrum portions 28. Namely, on insertion of the flexible printed circuit board 18 or flexible flat cable into the connector 10, it needs no insertion force, that is, the connector is of a so-called ZIF (zero-insertion force) construction.

As can be seen from the above description, the connector according to the invention can bring about the following significant functions and effects.

(1) According to the invention, the connector 10 includes a plurality of contacts 14 having at least one contact portion 26 adapted to contact a connecting object, a housing 12 for arranging and holding the contacts 14, the housing having a fitting opening 17 into which the connecting object is inserted, and a pivoting member 16 for causing the contacts 14 to be elastically deformed, wherein the contacts 14 each comprise a first piece 22 having the contact portion 26 at one end adapted to contact the connecting object and a pressure receiving portion 32 at the other end adapted to be urged by the pivoting member 16; a second piece 24 having a fulcrum portion 28 at one end and a connection portion 40 at the other end adapted to be connected to a substrate 20; a connecting portion 30 for connecting the first piece 22 and the fulcrum portion 28; and a second pressure receiving portion 34 substantially in the form of an L-shape extending between the connection portion 40 and the fulcrum portion 28; and the contact portion 26, the connecting portion 30, the fulcrum portion 28 and the connection portion 40 are arranged substantially in the form of a crank, and the contact portions 26 are adapted to extend into the fitting opening 17, wherein the pivoting member 16 comprises an actuating portion 48 for pivotally moving the pivoting member, urging portions 46 continuously arranged in the longitudinal direction of the pivoting member, and anchoring holes 50 each for receiving therein the second pressure receiving portion 34, and the pivoting member is mounted on the housing 12 so that the urging portions 46 are pivotally moved between the pressure receiving portions 32 and the second pressure receiving portions 34 of the contacts 14, and wherein when the connecting object and the connector 10 have not been connected (or the pivoting member 16 being in an opened position), the urging portions 46 are pivotally movable between the pressure receiving portions 32 and the second pressure receiving portions 34 so that the pressure receiving portions 32 are urged to raise the contact portions 26 in a direction retracting from the fitting opening, and when the connecting object and the connector 10 have been connected (or the pivoting member 16 in a closed position), the contact portions 26 of the contacts 14 extend into the fitting opening 17 to come into contact with the connecting object. Therefore, it is possible to construct a ZIF (zero-insertion force) type or LIF (low-insertion force) type connector and to arrange contacts on upper and lower sides even if there is a space for operating a pivoting member only on the side of insertion of a connecting object, thereby achieving stable electrical connection between the connecting object and the connector.

(2) According to the invention, the connector 10 includes a plurality of contacts 14 having at least one contact portion 26 adapted to contact a connecting object, a housing 12 for arranging and holding the contacts, the housing having a fitting opening 17 into which the connecting object is inserted, and a pivoting member 16 for causing the contacts 14 to be elastically deformed, wherein the contacts consist of two kinds of contacts 14, 141 arranged alternately staggered, wherein the contacts 14 of the one kind each comprise a first piece 22 having the contact portion 26 at one end adapted to contact the connecting object and a pressure receiving portion 32 at the other end adapted to be urged by the pivoting member 16; a second piece 24 having a fulcrum portion 28 at one end and a connection portion 40 at the other end adapted to be connected to a substrate 20; a connecting portion 30 for connecting the first piece 22 and the fulcrum portion 28; and a second pressure receiving portion 34 substantially in the form of an L-shape extending between the connection portion 40 and the fulcrum portion 28; and the contact portion 26, the connecting portion 30, the fulcrum portion 28 and the connection portion 40 are arranged substantially in the form of a crank, and the contact portions 26 are adapted to extend into the fitting opening 17, wherein the contacts 141 of the other kind each comprises a first piece 22 having the contact portion 26 at one end adapted to contact the connecting object and a pressure receiving portion 32 at the other end adapted to be urged by the pivoting member 16; a second piece 24 having a connection portion 40 at one end adapted to be connected to a substrate 20 and a fulcrum portion 28 at the other end; a connecting portion 30 for connecting the first piece 22 and the fulcrum portion 28; and a second pressure receiving portion 34 substantially in the form of a U-shape extending from the fulcrum portion 28; and the contact portion 26, the connecting portion 30, the fulcrum portion 28 and the connection portion 40 are arranged substantially in the form of a U-shape, and the contact portions 26 are adapted to extend into the fitting opening 17, wherein the pivoting member 16 comprises an actuating portion 48 for pivotally moving the pivoting member, urging portions 46 continuously arranged in the longitudinal direction of the pivoting member, and anchoring holes 50 each for receiving therein the second pressure receiving portion 34, and the pivoting member 16 is mounted on the housing 12 so that the urging portions 46 are pivotally moved between the pressure receiving portions 32 and the second pressure receiving portions 34 of the contacts 14, 141 of the first and second kinds, and wherein when the connecting object and the connector 10 have not been connected (or the pivoting member 16 being in an opened position), the urging portions 46 are pivotally movable between the pressure receiving portions 32 and the second pressure receiving portions 34 so that the pressure receiving portions 32 are urged to raise the contact portions 26 in a direction retracting from the fitting opening, and when the connecting object and the connector 10 have been connected (or the pivoting member 16 in a closed position), the contact portions 26 of the contacts 14, 141 extend into the fitting opening 17 to come into contact with the connecting object. Consequently, it is possible to construct a ZIF (zero-insertion force) type or LIF (low-insertion force) type connector and to arrange contacts on upper and lower sides even if there is a space for operating a pivoting member only on the side of insertion of a connecting object, thereby achieving stable electrical connection between the connecting object and the connector. Moreover, it is possible to arrange contacts with narrower pitches.

(3) According to the invention, the contacts each further comprise an extension portion 36 extending from the fulcrum portion 28 in such a direction that the extension portion 36 faces to the contact portion 26 of the first piece, and a further contact portion 26 located in a position facing to the contact portion 26 of the first piece and at a distal end of the extension portion 36. With this arrangement, it is readily possible to comply with the requirement for arranging contacts on upper and lower sides and the construction having the contacts arranged on upper and lower sides can achieve stable connection regardless a connecting object has contacts on either one of its surfaces.

(4) According to the invention, the contacts each further comprise a further contact portion 26 in a position facing to the contact portion 26 of the first piece and between the connection portion 40 and the fulcrum portion 28. Therefore, the construction having the contacts arranged on upper and lower sides can achieve stable connection regardless a connecting object has contacts on either one of its surfaces.

(5) According to the invention, there is provided a projection 42 extending from and located at a tip of either or both of the pressure receiving portion 32 and the second pressure receiving portion 34 of each of the contacts, and the urging portions 46 are pivotally movable between the pressure receiving portions 32 and the second pressure receiving portions 34. Consequently, the urging portions 46 of the pivoting member 16 do not depart from their operating positions and the ZIF structure can be easily provided by merely pivotally moving the urging portions 46, thereby obtaining stable connection.

(6) According to the invention, the pressure receiving portion 32 and the second receiving portion 34 of each of the contacts are substantially in parallel with each other so that the urging portion 46 of the pivoting member is pivotally movable between the pressure receiving portion 32 and the second pressure receiving portion 34. Therefore, the pivoting member 16 can be stably pivotally moved so that the connector is beneficially brought into a ZIF or LIF construction.

(7) According to the invention, the second pressure receiving portion 34 of each of the contacts is formed with a recess 41 on the inner side of the projection 42 so that the urging portion 46 is pivotally movable in the recess 41 and between the pressure receiving portion 32 and the second pressure receiving portion 34. Therefore, the pivoting member 16 can be stably pivotally moved so that the connector is beneficially brought into a ZIF or LIF construction.

(8) According to the invention, when the connecting object has been inserted into the connector, each of the urging portions 46 lies in the recess 41 of the second pressure receiving portion 34 of each of the contacts. With this construction, it is possible to miniaturize in height or reduce the overall height of the connector, and the contact portions 26 of the contacts securely extend into the inserting opening, thereby obtaining stable connection.

(9) According to the invention, the anchoring holes 50 of the pivoting member 16 are independent from one another. Therefore, the pivoting member 16 is rigid without being deformed, thereby obtaining its reliable pivotal movement.

(10) According to the invention, the housing 12 is provided at both the longitudinal ends with upper walls 55 partly forming the fitting opening 17. Therefore, a connecting object can be reliably inserted to a predetermined position.

(11) According to the invention, the connecting object is provided at both the longitudinal ends with anchoring portions 54, and the pivoting member 16 is provided with engaging portions 51 which are located at positions corresponding to and engaged with the anchoring portions 54 when the connecting object has been inserted into the connector. Accordingly, a connecting object can be reliably positioned and fixed in the connector.

(12) According to the invention, a hard substrate 20 is formed with a notch 52, and the connector 10 is connected to the hard substrate in a manner that the connector is accommodated in the notch 52 of the hard substrate. Therefore, it becomes possible to reduce the overall height of the connector by a height equivalent to the thickness of a substrate 20. Even if the height of the connector including a substrate 20 of 0.4 mm in thickness is 1 mm, the overall height of the connector including the substrate 20 can be of the order of 0.6 mm.

The invention will be more fully understood by referring to the following detailed specification and claims taken in connection with the appended drawings.

DESCRIPTION OF THE PREFERRED EMBODIMENTS

Figure 1A:
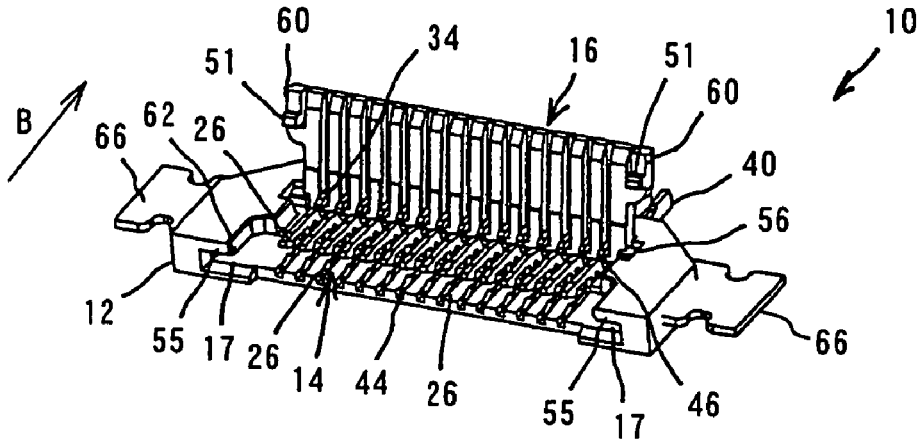
FIG. 1A is a perspective view of the connector according to the invention into which a flexible printed circuit board has not been inserted from the fitting opening.
Figure 1B:
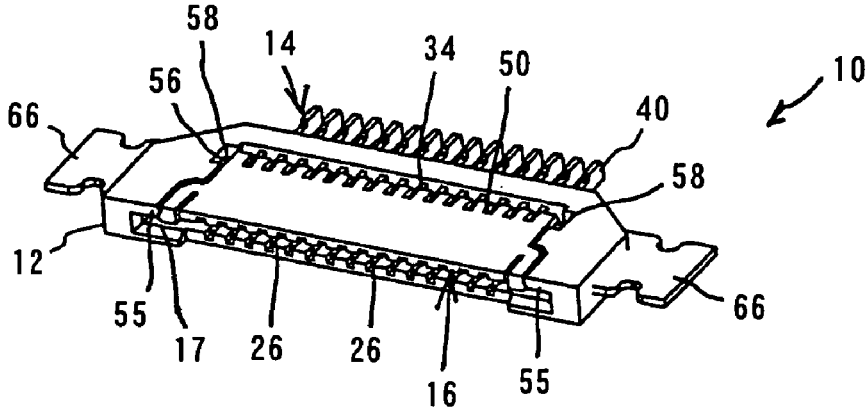
FIG. 1B is a perspective view of the connector shown in FIG. 1A into which a flexible printed circuit board has not been inserted, with the pivoting member closed.
Figure 1C:
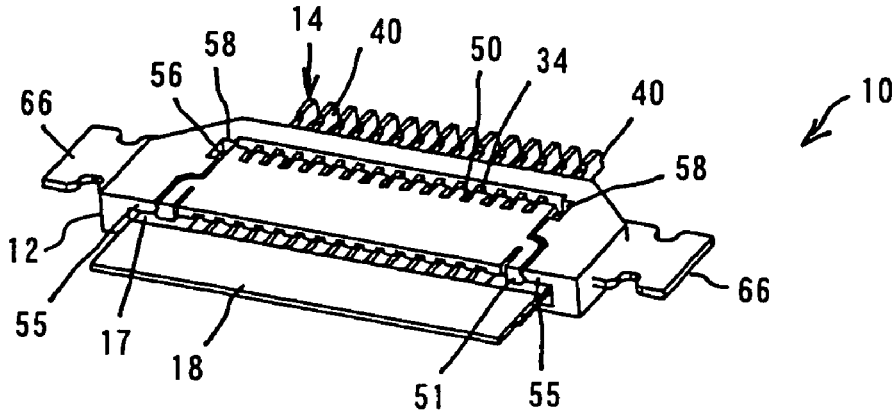
FIG. 1C is a perspective view of the connector shown in FIG. 1A into which a flexible printed circuit board has been inserted.
Figure 2A:
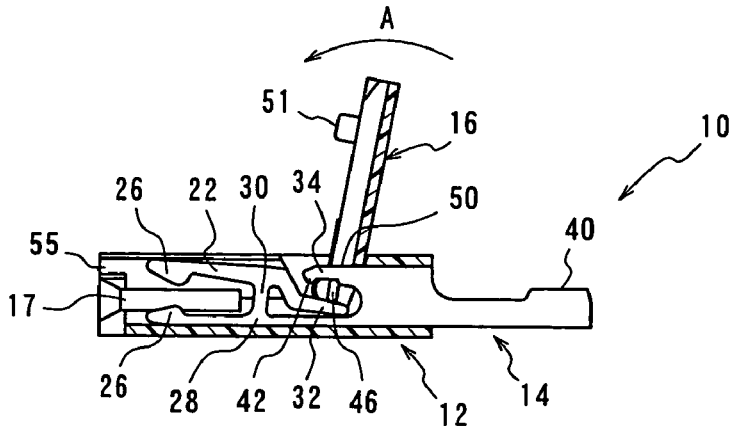
FIG. 2A is a sectional view of the connector according to the invention into which a flexible printed circuit board has not been inserted.
Figure 2B:
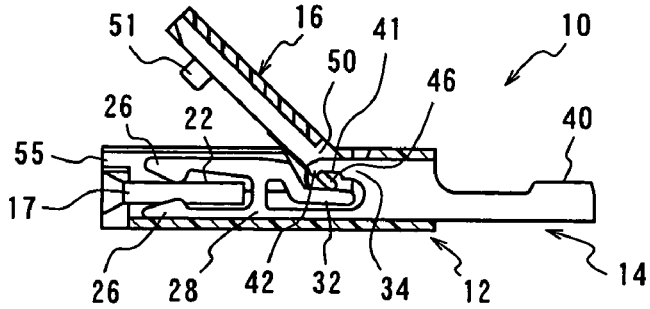
FIG. 2B is a sectional view of the connector into which a flexible printed circuit board has not been inserted, with the pivoting member pivotally moved about halfway.
Figure 2C:
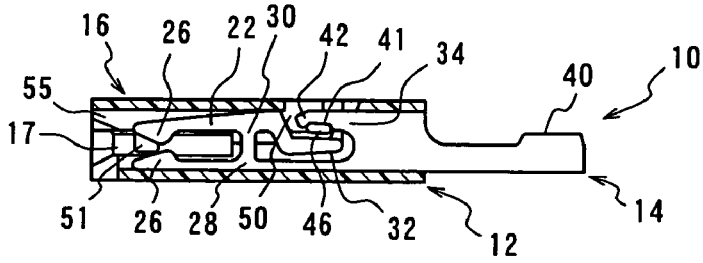
FIG. 2C is a sectional view of the connector into which a flexible printed circuit board has not been inserted, with the pivoting member closed.
Figure 2D:
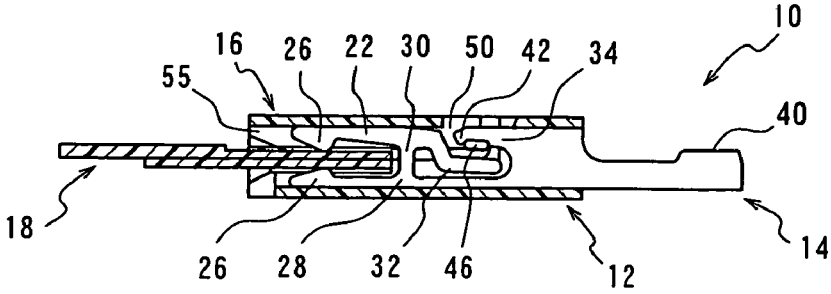
FIG. 2D is a sectional view of the connector into which a flexible printed circuit board has been inserted.
Figure 3:
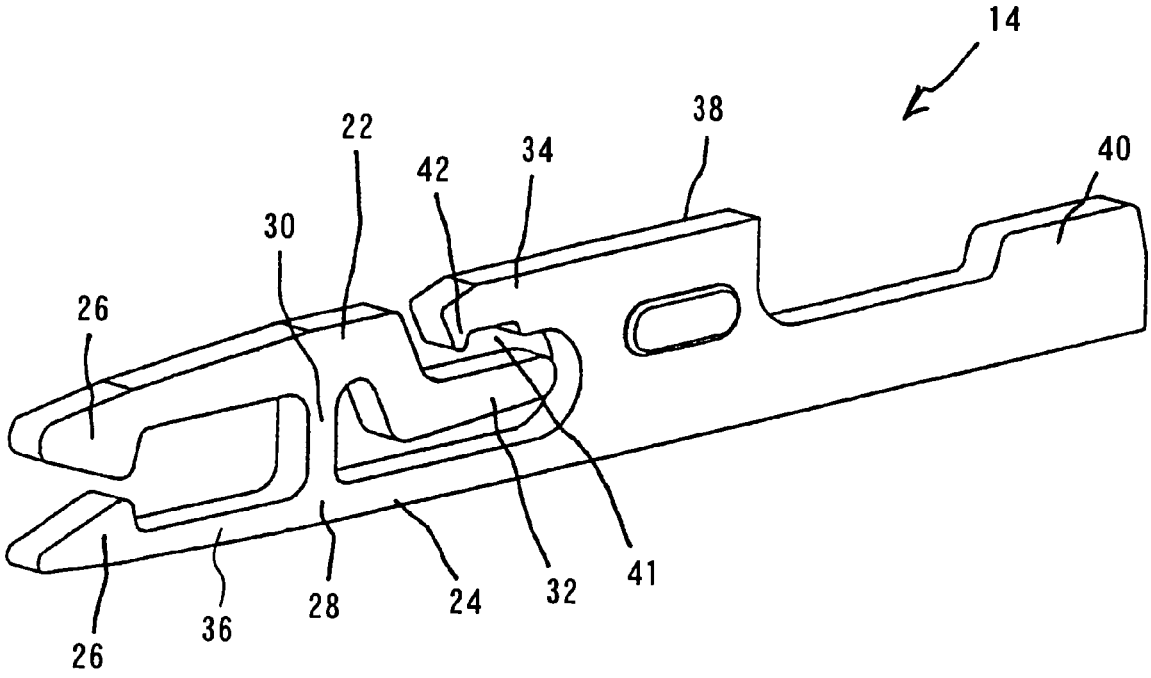
FIG. 3 is a perspective view of a contact used in the connector according to the invention.
Figure 4:
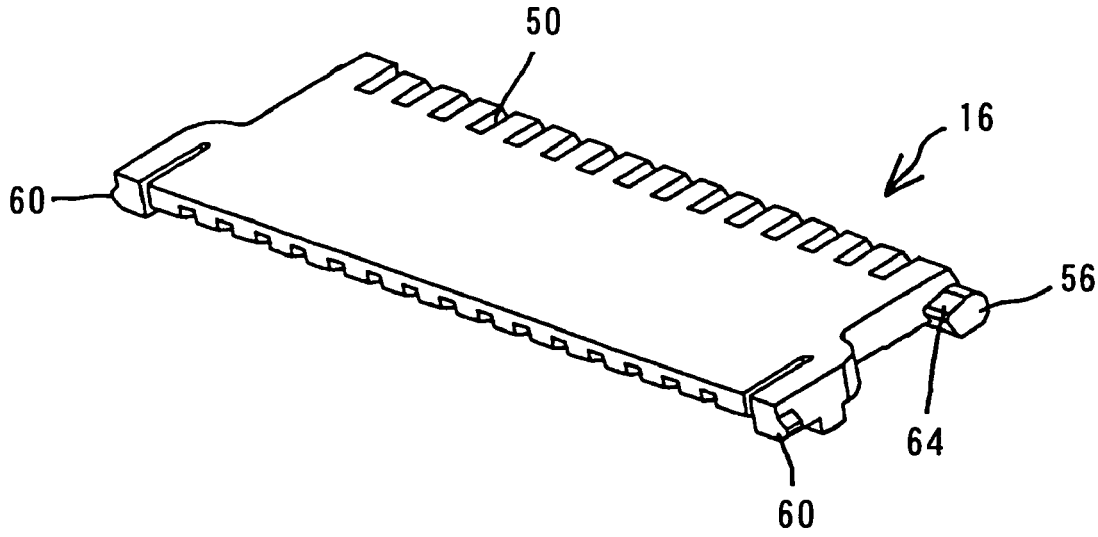
FIG. 4 is a perspective view of a pivoting member used in the connector according to the invention.
Figure 4:
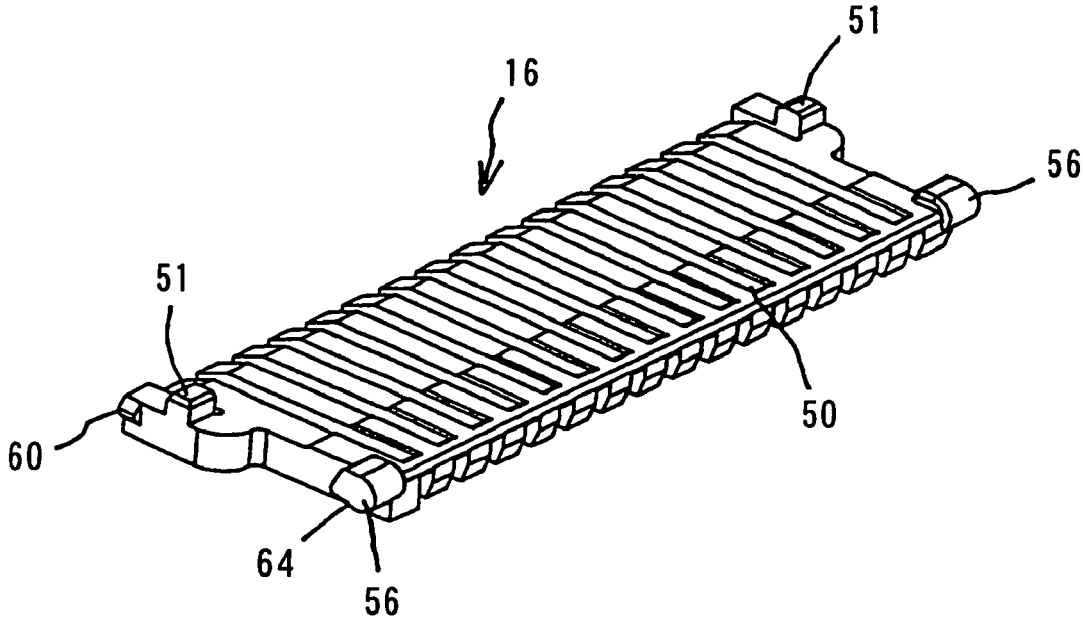
Figure 5:
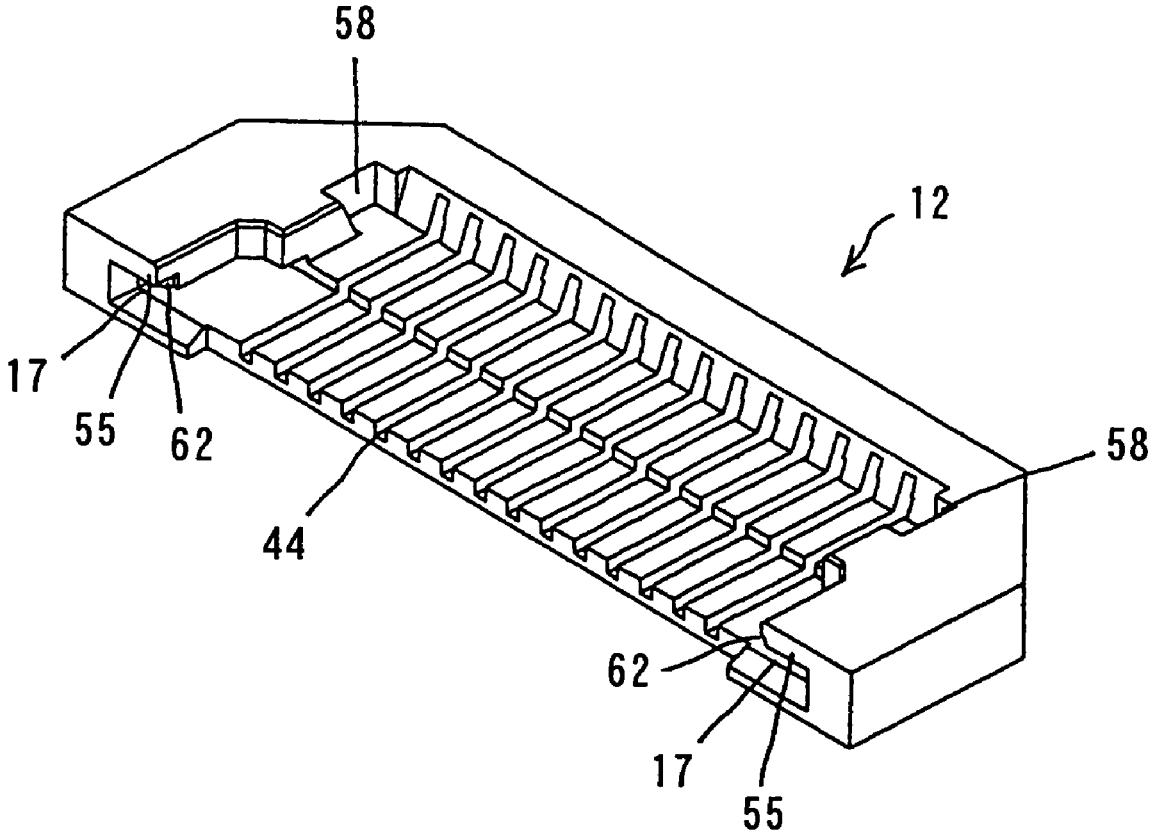
FIG. 5 is a perspective view of a housing used in the connector according to the invention.
Figure 6:
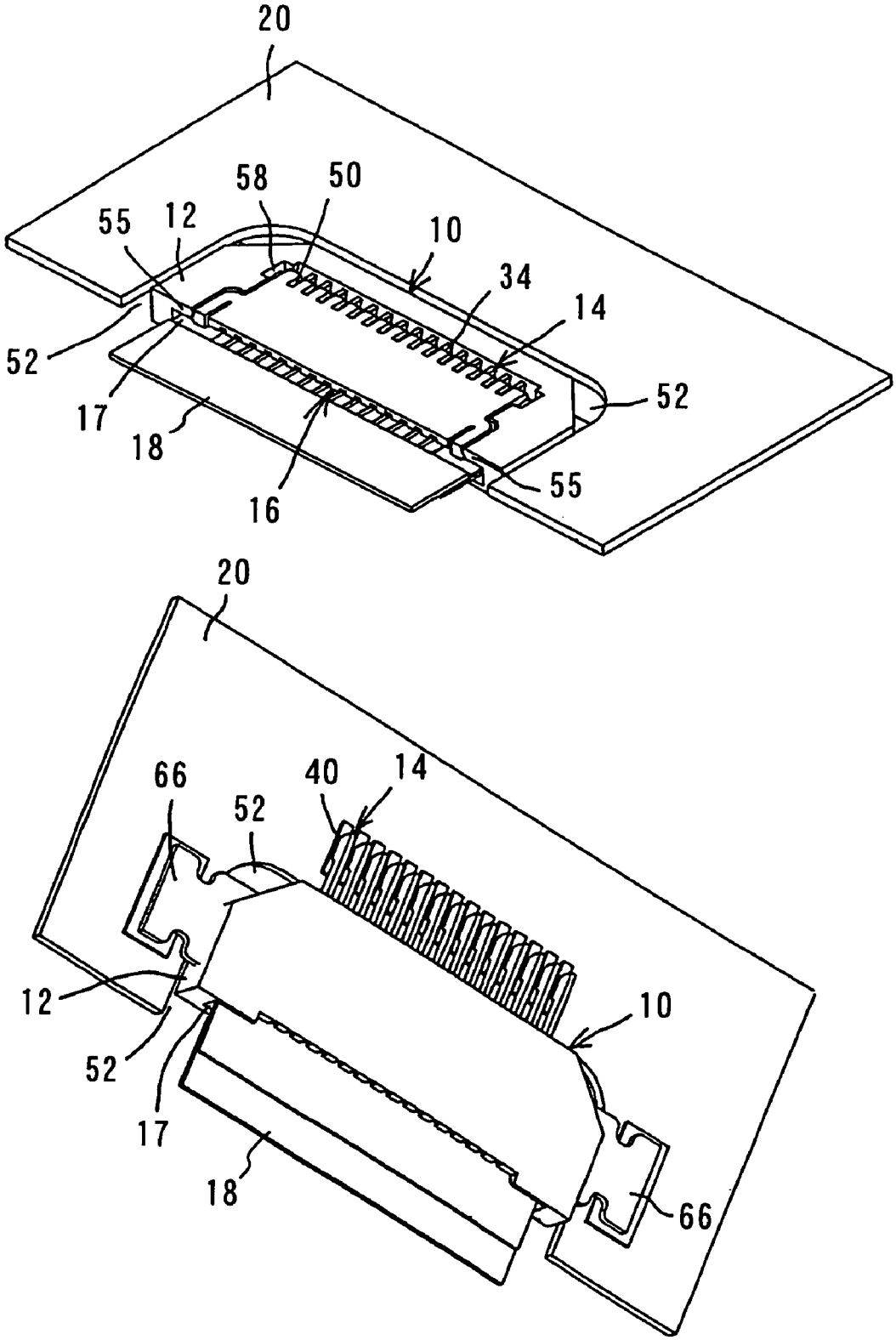
FIG. 6 is an explanatory view for mounting the connector according to the invention on a substrate.
Figure 7A:
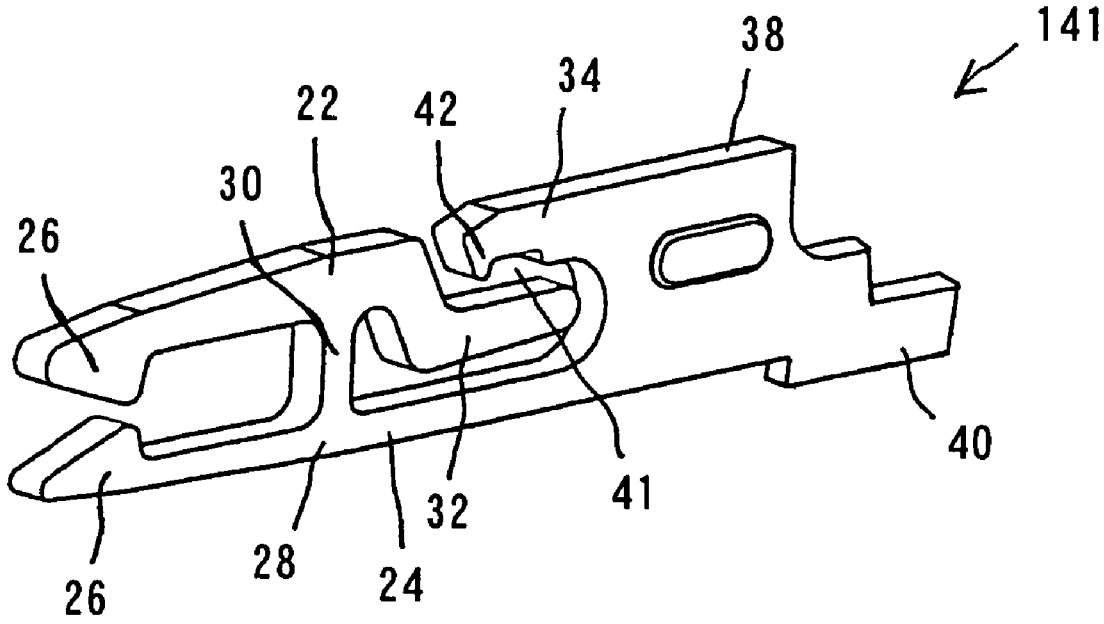
FIG. 7A is a perspective view of a contact of one kind used in the connector according to the invention.
Figure 7B:
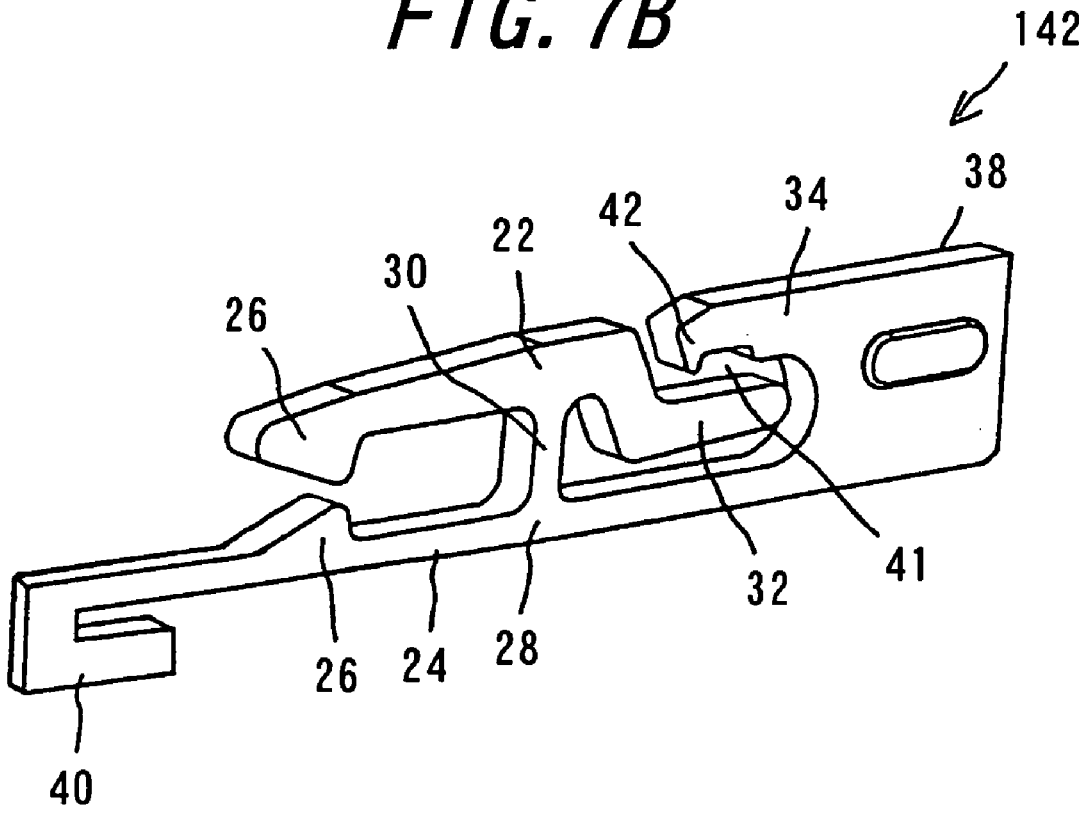
FIG. 7B is a perspective view of a contact of the other kind.

One embodiment of the connector according to the invention will be explained with reference to FIGS. 1A to 7B hereinafter. FIG. 1A is a perspective view of the connector according to the invention viewed from the fitting side, not having a flexible printed circuit board inserted thereinto. FIG. 1B is a perspective view of the connector shown in FIG. 1A viewed from the fitting side, not having a flexible printed circuit board inserted thereinto but with a pivoting member positioned in its closed position. FIG. 1C is a perspective view of the connector viewed from the fitting side, with a flexible printed circuit board inserted thereinto. FIG. 2A is a sectional view of the connector shown in FIG. 1A not having the flexible printed circuit board inserted thereinto, and FIG. 2B is a sectional view of the connector not having the flexible printed circuit board inserted thereinto, but with the pivoting member in the course of its pivotal movement. FIG. 2C is a sectional view of the connector not having the inserted circuit board, but with the pivoting member in its closed position, and FIG. 2D is a sectional view of the connector with the inserted circuit board. FIGS. 3, 4 and 5 are perspective views of a contact, the pivoting member, and a housing used in the connector according to the invention, respectively. FIG. 6 is an explanatory view of the connector according to the invention mounted on a substrate. FIG. 7A is a perspective view of a contact of one kind, and FIG. 7B is a perspective view of a contact of the other kind according to the invention.

The connector according to the invention mainly comprises a housing, a pivoting member, and contacts. Before explaining the components of the connector, the flexible printed circuit board 18 will be explained. The flexible circuit board 18 comprises at least contact portions adapted to be in contact with contact portions 26 of the contacts 14, and patterns connected from the contact portions of the board to circuits. The contact portions of the flexible printed circuit board in the embodiment are arranged on its upper and lower faces. By using such a flexible circuit board, the electrical connection of the connector can be stabilized against vibration and the like and the flexibility of the flexible circuit board can be maintained.

The components of the connector 10 according to the invention will be explained with reference to the drawings. First the contact 14 will be explained which is one subject feature of the invention. The contact 14 is made of a metal and formed by means of the press-working of the known technique. Preferred metals from which to form the contact 14 include brass, beryllium copper, phosphor bronze and the like which comply with the requirements such as springiness, electric conductivity and the like.

The contact 14 comprises at least a first piece 22 having a contact portion 26 at one end adapted to contact a connecting object such as a flexible printed circuit board, and a pressure receiving portion 32 at the other end adapted to be urged by the pivoting member 16; a second piece 24 having a fulcrum portion 28 at one end and a connection portion 40 at the other end to be connected to a substrate 20; a connecting portion 30 for connecting the first piece 22 and the fulcrum portion 28; and a second pressure receiving portion 34 substantially in the form of an "L-shape" extending between the connection portion 40 and the fulcrum portion 28. The contact portion 26 of the first piece 22, the jointing or connecting portion 30, the fulcrum portion 28 and the connection portion 40 are arranged substantially in the form of a crank.

The contact portion 26 is in the form of a protrusion to facilitate the contact with the connecting object such as the flexible printed circuit board. Although the connection portion 40 is of a surface mounting type (SMT) as shown in FIGS. 1A to 1C, it will be apparent that it may be of a dip type. In the illustrated embodiment of the connector of contacts each being intended to have upper and lower contact portions, the contact 14 further comprises an extension portion 36 extending from the fulcrum portion in such a direction that the extension portion 36 faces to the contact portion 26, and a contact portion 26 is provided on the forward end of the extension portion 36 in the similar manner to the first mentioned contact portion 26 formed on the first piece 22. With this construction, the flexible printed circuit board 18 or a flexible flat cable is embraced between the contact portions of the first pieces 22 and the contact portions 26 of the extension portions 36 of the contacts 14. In other words, there are provided the contact portions 26 of the contacts 14 on both the sides of the inserting direction of the flexible printed circuit board 18 or flexible flat cable so that the circuit board 18 or flat cable is embraced by the contact portions on both the sides, thereby achieving a reliable connection between the contacts 14 of the connector 10 and the circuit board 18 or flat cable.

With the connector 10 into which the circuit board 18 or flat cable has not been inserted and the pivoting member 16 positioned in its closed position as shown in FIG. 2C, the contact portions 26 of the contacts 14 extend into a fitting opening 17 of the housing 12, gaps between the upper and lower contact portions 26 being suitably designed so as to obtain a predetermined contact force between the contacts and the circuit board or flat cable. For this purpose, the lower contact potions 26 of the contacts 14 may be so designed that they are somewhat raised from bottoms of their inserting grooves 44 of the housing 12. In the case of contacts not having the lower contact portions 26 and the extension portion 36 (just the same as the contacts 14 with the lower contact portion 26 and the extension portion 36 removed, not shown), likewise the upper contact portions 26 may be designed so as to be somewhat away from bottoms of the inserting grooves 44.

The fulcrum portion 28, the connecting portion 30, the pressure receiving portion 32, and the second pressure receiving portion 34 serve to form a so-called "ZIF (zero-insertion force)" type structure which need not an inserting force on insertion of a connecting object such as a flexible printed circuit board or flat cable. When the connecting object such as the circuit board or flat cable is being inserted into the fitting opening 17 of the housing 12, the pivoting member 16 is in an opened position. In other words, urging portions 46 of the pivoting member 16 stand obliquely between the pressure receiving portions 32 and the second pressure receiving portions 34 as shown in FIG. 2A so that the pressure receiving portions 32 are urged downwardly as viewed in the drawing by the urging portions 46. Therefore, the connecting portions 30 of the contacts 14 are tilted about the fulcrum portions 28 toward the pressure receiving portions 32 so that the contact portions 26 are raised, with the result that the contact portions 26 are retracted from the fitting opening 17 of the housing 12. Sizes and shapes of the fulcrum portion 28, the connecting portion 30, the pressure receiving portion 32 and the second pressure receiving portion 34 may be suitably designed to achieve these functions. In consideration of these functions, the second pressure receiving portion 34 may be suitably designed to be nearly rigid or difficult to be deformed. While the "ZIF" type construction is employed in the illustrated embodiment, it is to be understood that it may be of "LIF" type construction.

When the pivoting member 16 is pivotally moved one half of the way from its opened position as shown in FIG. 2A in a direction shown by an arrow A, the pivoting member 16 comes into the position shown in FIG. 2B. When the pivoting member 16 is further pivotally moved from the position shown in FIG. 2B into its closed position wherein the flexible printed circuit board 18 has been inserted with the pivoting member 16 closed as shown in FIG. 2D, the urging portions 46 of the pivoting member 16 are substantially horizontal (no urging action of the urging portions) between the pressure receiving portions 32 and the second pressure receiving portions 34 so that the contact portions 26 of the contacts 14 are returned to the position shown in FIG. 2C described above so as to be in contact with the flexible printed circuit board 17. As the contact pressure will be determined by gaps or clearances between the upper and lower contact portions, it is possible to ensure a more stable electric connection because the invention does not employ the construction for urging down the contact portions by raising the pressure receiving portions of the contacts by means of the pivoting member, as is the case with the Patent Literatures 1-4.

It is preferable to provide an inclined portion 43 in the proximity of the connecting portion 30 so that the pressure receiving portion 32 and the second pressure receiving portion 34 are arranged substantially in parallel with each other, while permitting the urging portion 46 to be pivotally moved therebetween, thereby enabling the stable pivotal movement of the urging portions 46. Either or both of the pressure receiving portion 32 and the second pressure receiving portion 34 may be provided at the distal end with a projection 42 extending toward each other. In the illustrated embodiment, the second pressure receiving portion 34 only is provided with a projection 42. The second pressure receiving portion 34 is further formed with a recess 41 adjacent the projection 42 for receiving the urging portion 46 therein when the flexible printed circuit board 18 has been connected to the connector as shown in FIG. 2D, thereby achieving the miniaturization in height or reduced overall height of the connector and stable and compact pivotal movement of the urging portions 46 and preventing disengagement of the urging portions 46. Sizes and shapes of the projection 42 and the recess 41 may be suitably designed in consideration of such functions.

Explaining the movement of the urging portion 46, it stands obliquely so that its top portion is slightly tilted in clockwise direction viewed in FIG. 2A, when the pivoting member 16 is in its opened position. When the pivoting member 16 is pivotally moved about one half of the way from the opened position in the direction shown by the arrow A in FIG. 2A, the upper end of the urging portion 46 is moved toward the projection 42 as shown in FIG. 2B. On further pivotal movement of the pivoting member 16, the urging portion 46 is pivotally moved about the projection 42 as a fulcrum so that finally the urging portion 46 is in the recess 41 as shown in FIG. 2D.

The connection portion 40 provided on the other end of the second piece 24 of the contact 14 is to be connected to a substrate 20 as by reflow soldering. For this purpose, size and shape of the connection portion 40 may be suitably designed in consideration of connection position and connected strength onto the substrate and specification of the substrate. In the illustrated embodiment, the connection portions 40 of the contacts 14 are connected to lands on the lower surface of a substrate 20 as shown in FIG. 6. The connection portion 40 is located at one end of the linearly extending portion of the second piece 24 and extends somewhat upwardly to form an extended portion which is adapted to be connected to the land of the substrate 20. Sizes of the extending portion and the upwardly extended portion may be suitably designed according to the specification of the substrate 20.

A fixed portion 38 of the contact 14 is a portion to be fixed to the housing 12 by press-fitting, hooking (lancing), welding or the like. In the illustrated embodiment, the contact is provided with an arrow-head (not shown) which is then fixed in the housing by press-fitting for fixing the contact 14. The size of the arrow-head may be designed to ensure a reliable holding force for the contact. In the illustrated embodiment, the fixed portion 38 is provided close to the second pressure receiving portion 34 to prevent the deformation of the second pressure receiving portion 34.

The pivoting member 16 will be then explained. The pivoting member 16 is formed from an electrically insulating plastic material by means of the injection molding of the known technique. The materials suitable for the pivoting member 16 include polybutylene terephthalate (PBT), polyamide (66PA or 46PA), liquid crystal polymer (LCP), polycarbonate (PC) and the like and combination thereof in consideration of dimensional stability, workability, manufacturing cost and the like. The pivoting member 16 mainly comprises an actuating portion 48, axles 56 adapted to be fitted in the housing 12 for pivotally mounting the pivoting member 16 on the housing 12, urging portions 46 for urging the pressure receiving portions 32 of the contacts 14, and anchoring holes 50 adapted to engage the second pressure receiving portions 34 of the contacts 14. The axles 56 are fulcrums for the pivotal movement of the pivoting member 16 and are suitably fitted in longitudinal ends of the housing 12. The axles 56 are each formed with an inclined surface 64 for facilitating the insertion of the axles into bearings 58 of the housing 12 and preventing parts of the axles from abutting against the housing when the pivoting member is pivotally moved. The pivoting member 16 is further provided at longitudinal ends with locking portions 60 adapted to engage the housing 12 for preventing the pivoting member 16 from being raised (upwardly viewed in the drawing) when the pressure receiving portions 20 of the contacts 14 are urged by the pivoting member 16. The shape and size of the locking portions 60 may be any ones insofar as they can engage the housing 12 and may be suitably designed in consideration of the above function and the size and strength of the connector.

The urging portions 46 are pivotally moved between the pressure receiving portions 32 and the second pressure receiving portions 34 to urge the pressure receiving portions 32 and are preferably of an elongated shape, particularly elliptical in the illustrated embodiment. With such an elliptical shape, when the pivoting member 16 is pivotally moved in a direction opposite to the direction shown by the arrow A from the state shown in FIG. 2C to the state shown in FIG. 2A to rotate the urging portions 46 between the pressure receiving portions 32 and the second pressure receiving portions 34 of the contacts 14, the pressure receiving portions 32 of the contacts 14 are moved downwardly with variation in contacting height owing to the elliptical shape of the urging portions 46, thereby raising the contact portions (upper contact portions) 26 to avoid the contact portions from extending into the fitting opening 17 of the housing 12. In other words, the gaps between the upper and lower contact portions 26 are widened. The shape of the urging portions 46 may be any shape insofar as the urging portions 46 can be rotated between the pressure receiving portions 32 and the second pressure receiving portions 34 of the contacts 14 and the pressure receiving portions 32 of the contacts 14 can be moved downwardly with the aid of the difference in length, for example, between major and minor axes of an ellipse which is the cross-sectional shape of the urging portions of the pivoting member.

Moreover, the pivoting member 16 is provided with anchoring holes 50 independent from one another with which the projections 42 of the second pressure receiving portions 34 of the contacts 14 are engaged for the purpose of preventing the center of the pivoting member 16 from being deformed in the direction shown by an arrow B in FIG. 1A owing to the strong reaction against the pivotal movement of the pivoting member 16. By providing the anchoring holes 50 independently from one another, the strength of the pivoting member 16 is increased, and the deformation of the pivoting member 16 is prevented when the pivoting member 16 is pivotally moved.

The pivoting member 16 is further provided with engaging portions 51 which are located in positions corresponding to anchoring portions 54 provided at longitudinal ends of the connecting object and adapted to engage the anchoring portions 54 of the object. In the illustrated embodiment, the engaging portions 51 are protrusions, while the anchoring portions 54 of the connecting object are recesses. Such constructions ensure reliable positioning and achieve stable holding of the connecting object. The size and shape of the protrusions as the engaging portions 51 may be suitably designed in consideration of specifications of the connecting object, the strength of the pivoting member 16, and miniaturization of the connector.

The housing 12 will be then explained. The housing 12 is formed from an electrically insulating plastic material by means of the injection molding of the known technique. The materials suitable for the housing 12 include polybutylene terephthalate (PBT), polyamide (66PA or 46PA), liquid crystal polymer (LCP), polycarbonate (PC) and the like and combination thereof in consideration of dimensional stability, workability, manufacturing cost and the like.

The housing 12 is formed with inserting grooves 44 into which a required number of contacts 14 are inserted and fixed thereat, respectively, by press-fitting, hooking (lancing), welding or the like. The housing 12 is further provided with bearings 58 at the longitudinal ends for receiving the axles 56 of the pivoting member 16 for its pivotal movement. The shape and size of the bearings 58 may be any ones insofar as the axles 56 of the pivoting member 16 are received therein to permit the pivotal movement of the pivoting member 16 and may be suitably designed in consideration of their function, and strength and size of the housing 12. The housing 12 is further formed with anchoring grooves 62 at positions of the longitudinal ends corresponding to the locking portions 60 of the pivoting member 16.

Furthermore, the housing 12 is formed with a fitting opening 17 into which a connecting object such as a flexible printed circuit board 18 or flat cable is inserted. In fact, the fitting opening 17 is formed by providing upper walls 55 at the longitudinal ends. The size of the fitting opening 17 is suitably designed to be able to receive the connecting object. The part of the housing 12 to be occupied by the pivoting member 16 mounted thereon forms a space so that part of the fitting opening is formed by the housing 12 and the pivoting member 16.

With the connector 10 according to the invention, the substrate is provided with fixation tags 66 for securely connecting the connector to the substrate 20.

Finally, mounting of the connector 10 onto the substrate 20 will be explained. In order to comply with the requirement for miniaturization in height or reduced overall height of connectors in recent years, the hard substrate 20 is formed with a notch 52 so that the connector 10 is mounted on the substrate in a manner that the connector is accommodated in the notch 52 of the substrate, thereby achieving the reduced overall height of the connector including the substrate. In other words, it is possible to reduce the height of the connector by a thickness of the substrate 20. Even if the height of a connector including a substrate of 0.4 mm in thickness is 1 mm, the overall height of the connector including the substrate 20 according to the invention can be of the order of 0.6 mm. The size of the notch 52 of the substrate 20 may be suitably designed in consideration of the size of the connector 10, the strength of the substrate 20, and the mounting position and the like.

Another embodiment of the invention will be explained, whose contacts only are shown in FIGS. 7A and 7B, although an entire connector is not shown. The connector of this embodiment mainly comprises a housing, contacts and a pivoting member in a similar manner to the connector described above. The subject feature of the present embodiment lies in two kinds of contacts 141 and 142 which are arranged alternately staggered by inserting these two kinds of the contacts into the housing 12 alternately in opposite directions. The pivoting member 16 is similar to that described above. As shown in FIG. 7A, the contact 141 of the one kind is substantially the same as the contact 14 shown in FIG. 3 with the exception of the connection portion 40 downwardly extending. Therefore, the contacts 141 will not be described in further detail.

The contact 142 of the other kind will be explained with the reference to FIG. 7B. The contact 142 of the other kind is made of a metal and formed by means of the press-working of the known technique. Preferred metals from which to form the contacts 142 are also the same as those of the contacts 14 and 141. The contact 142 of the other kind comprises a first piece 22 having at least a contact portion 26 at one end adapted to contact a connecting object and a pressure receiving portion 32 at the other end to be urged by the pivoting member 16; a second piece 24 having a connection portion 40 at one end to be connected to a substrate and a fulcrum portion 28 at the other end; a connecting portion 30 for the first piece 22 and the fulcrum portion 28; and a second pressure receiving portion 34 substantially in the form of a U-shape extending from the fulcrum portion 28. The contact portion 26 of the first piece 22, the connecting portion 30, the fulcrum portion 28 and the connection portion 40 are arranged substantially in a U-shape.

The contact portion 26 is in the form of a protrusion to facilitate the contact with the connecting object such as the flexible printed circuit board. Although the connection portion 40 is of a surface mounting type (SMT) as shown in FIG. 7B, it will be apparent that it may be of a dip type. In the illustrated embodiment of the connector of contacts each being intended to have upper and lower contact portions, the contact 142 further comprises a contact portion 26 similar to the contact portion 26 of the first piece 22 and located between the fulcrum portion 28 and the connection portion 40 to face to the contact portion 26 of the first piece 22. With this construction, the flexible printed circuit board 18 or a flexible flat cable is embraced between the contact portions of the first pieces 22 and the contact portions 26 of the second piece 24 of the contacts 142. In other words, there are provided the contact portions 26 of the contacts 142 on both the sides of the inserting direction of the flexible printed circuit board 18 or flexible flat cable so that the circuit board 18 or flat cable is embraced by the contact portions on both the sides, thereby achieving a reliable connection between the contacts 142 of the connector 10 and the circuit board 18 or flat cable.

In the condition of the connector with the pivoting member 16 closed and the connecting object such as the flexible printed circuit board 18 or flat cable has not been inserted into the connector as shown in FIG. 2C, the contact portions 26 of the contacts 142 extend into the fitting opening 17 of the housing 12, clearances or gaps between the upper and lower contact portions 26 being suitably designed with a view to obtaining the predetermined contact force. For this purpose, the lower contact potions 26 may be so designed that the lower contact portions 26 of the contacts 142 are somewhat raised from inserting grooves 44 of the housing 12. In the case of contacts not having the lower contact portions 26 (just the same as the contacts 14 with the lower contact portion 26 and the extension portion 36 removed, not shown), the upper contact portions 26 may be designed so as to be somewhat away from bottoms of the inserting grooves 44.

The great difference of the contact 142 from the contacts 14 and 141 is the position of the connection portion 40 which is located on the side of the fitting opening 17.

Similar to those of the contacts 14 are the functions and effects of the fulcrum portions, the connecting portions 30, the pressure receiving portions 32 and the second pressure receiving portions 34, and the opened and closed conditions and constructions of the pivoting member 16 and further the projections 42, the recesses 41 and the fixed portions 38 of the contacts 142, which will not be described in further detail.

Forming an important aspect of the present invention is to provide a connector which enables operation of the pivoting member 16 on the side of the fitting opening even if there is an operating space only on the side of the fitting opening for pivotally moving the pivoting member, and enables a ZIF (zero-insertion force) type connector and a connector including contacts having upper and lower contact portions. With this construction, the pivoting member 16 can be operated on the side of the fitting opening 17 of the housing. When the pivoting member 16 is opened (state prior to the insertion of a flexible printed circuit board), the clearances or gaps between the contact portions 26 of the contacts are widened (the upper contact portions 26 do not extend into the fitting opening 17), while when the pivoting member 16 is closed (state the flexible printed circuit board 18 has been inserted), the clearances between the contact portions 26 are reduced (the upper contact portions 26 extend into the fitting opening 17).

The invention is applicable to connectors for use in mobile phones or cellular phones, notebook personal computers, digital cameras and the like, and more particularly to connectors superior in stable electrical connection with a connecting object such as a flexible printed circuit board or flexible flat cable.

While the invention has been particularly shown and described with reference to the preferred embodiments thereof, it will be understood by those skilled in the art that the foregoing and other changes in form and details can be made therein without departing from the spirit and scope of the invention.

What is claimed is:

1. A connector including a plurality of contacts having at least one contact portion adapted to contact a connecting object, a housing for arranging and holding said contacts, said housing having a fitting opening into which said connecting object is inserted, and a pivoting member for causing said contacts to be elastically deformed, wherein said contacts each comprise a first piece having the contact portion at one end adapted to contact said connecting object and a pressure receiving portion at the other end adapted to be urged by said pivoting member; a second piece having a fulcrum portion at one end and a connection portion at the other end adapted to be connected to a substrate; a connecting portion for connecting said first piece and said fulcrum portion; and a second pressure receiving portion substantially in the form of an L-shape extending between the connection portion and the fulcrum portion; and said contact portion, said connecting portion, said fulcrum portion and said connection portion are arranged substantially in the form of a crank, and said contact portions are adapted to extend into said fitting opening, wherein said pivoting member comprises an actuating portion for pivotally moving the pivoting member, urging portions continuously arranged in the longitudinal direction of the pivoting member, and anchoring holes each for receiving therein said second pressure receiving portion, and said pivoting member is mounted on said housing so that said urging portions are pivotally moved between said pressure receiving portions and said second pressure receiving portions of the contacts, and wherein when said connecting object and said connector have not been connected (or said pivoting member being in an opened position), said urging portions are pivotally movable between said pressure receiving portions and said second pressure receiving portions so that said pressure receiving portions are urged to raise said contact portions in a direction retracting from said fitting opening, and when said connecting object and said connector have been connected (or said pivoting member in a closed position), said contact portions of the contacts extend into said fitting opening to come into contact with said connecting object.

2. The connector as set forth in claim 1, wherein a hard substrate is formed with a notch, and said connector is connected to said hard substrate in a manner that the connector is fitted in the notch of the hard substrate.

3. The connector as set forth in claim 1, wherein said contacts each further comprise an extension portion extending from said fulcrum portion in such a direction that the extension portion faces to said contact portion of the first piece, and a further contact portion located in a position facing to said contact portion of the first piece and at a distal end of said extension portion.

4. The connector as set forth in claim 3, wherein said anchoring holes of the pivoting member are independent from one another.

5. The connector as set forth in claim 3, wherein said housing is provided at both the longitudinal ends with upper walls partly forming said fitting opening.

6. The connector as set forth in claim 5, wherein said connecting object is provided at both the longitudinal ends with anchoring portions, and said pivoting member is provided with engaging portions which are located at positions corresponding to and engaged with said anchoring portions when said connecting object has been inserted into the connector.

7. The connector as set forth in claim 3, wherein there is provided a projection extending from and located at a tip of either or both of said pressure receiving portion and said second pressure receiving portion of each of said contacts, and said urging portions are pivotally movable between said pressure receiving portions and said second pressure receiving portions.

8. The connector as set forth in claim 7, wherein said second pressure receiving portion of each of said contacts is formed with a recess on the inner side of said projection so that said urging portion is pivotally movable in said recess and between said pressure receiving portion and said second pressure receiving portion.

9. The connector as set forth in claim 8, wherein when the connecting object has been inserted into said connector, each of said urging portions lies in said recess of said second pressure receiving portion of each of said contacts.

10. The connector as ser forth in claim 3, wherein said pressure receiving portion and said second receiving portion of each of said contacts are substantially in parallel with each other so that the urging portion of the pivoting member is pivotally movable between said pressure receiving portion and said second pressure receiving portion.

11. The connector as set forth in claim 10, wherein said second pressure receiving portion of each of said contacts is formed with a recess on the inner side of said projection so that said urging portion is pivotally movable in said recess and between said pressure receiving portion and said second pressure receiving portion.

12. The connector as set forth in claim 11, wherein when the connecting object has been inserted into said connector, each of said urging portions lies in said recess of said second pressure receiving portion of each of said contacts.

13. A connector including a plurality of contacts having at least one contact portion adapted to contact a connecting object, a housing for arranging and holding said contacts, said housing having a fitting opening into which said connecting object is inserted, and a pivoting member for causing said contacts to be elastically deformed, wherein said contacts consist of two kinds of contacts arranged alternately staggered, wherein said contacts of the one kind each comprise a first piece having the contact portion at one end adapted to contact said connecting object and a pressure receiving portion at the other end adapted to be urged by said pivoting member; a second piece having a fulcrum portion at one end and a connection portion at the other end adapted to be connected to a substrate; a connecting portion for connecting said first piece and said fulcrum portion; and a second pressure receiving portion substantially in the form of an L-shape extending between the connection portion and the fulcrum portion; and said contact portion, said connecting portion, said fulcrum portion and said connection portion are arranged substantially in the form of a crank, and said contact portions are adapted to extend into said fitting opening, wherein said contacts of the other kind each comprises a first piece having the contact portion at one end adapted to contact said connecting object and a pressure receiving portion at the other end adapted to be urged by said pivoting member; a second piece having a connection portion at one end adapted to be connected to a substrate and a fulcrum portion at the other end; a connecting portion for connecting said first piece and said fulcrum portion; and a second pressure receiving portion substantially in the form of a U-shape extending from said fulcrum portion; and said contact portion, said connecting portion, said fulcrum portion and said connection portion are arranged substantially in the form of a U-shape, and said contact portions are adapted to extend into said fitting opening, wherein said pivoting member comprises an actuating portion for pivotally moving the pivoting member, urging portions continuously arranged in the longitudinal direction of the pivoting member, and anchoring holes each for receiving therein said second pressure receiving portion, and said pivoting member is mounted on said housing so that said urging portions are pivotally moved between said pressure receiving portions and said second pressure receiving portions of the contacts of the one and the other kind, and wherein when said connecting object and said connector have not been connected (or said pivoting member being in an opened position), said urging portions are pivotally movable between said pressure receiving portions and said second pressure receiving portions so that said pressure receiving portions are urged to raise said contact portions in a direction retracting from said fitting opening, and when said connecting object and said connector have been connected (or said pivoting member in a closed position), said contact portions of the contacts extend into said fitting opening to come into contact with said connecting object.

14. The connector as set forth in claim 13, wherein a hard substrate is formed with a notch, and said connector is connected to said hard substrate in a manner that the connector is fitted in the notch of the hard substrate.

15. The connector as set forth in claim 13, wherein said anchoring holes of the pivoting member are independent from one another.

16. The connector as set forth in claim 13, wherein said housing is provided at both the longitudinal ends with upper walls partly forming said fitting opening.

17. The connector as set forth in claim 16, wherein said connecting object is provided at both the longitudinal ends with anchoring portions, and said pivoting member is provided with engaging portions which are located at positions corresponding to and engaged with said anchoring portions when said connecting object has been inserted into the connector.

18. The connector as set forth in claim 13, wherein said contacts each further comprise a further contact portion in a position facing to the contact portion of the first piece and between said connection portion and said fulcrum portion.

19. The connector as set forth in claim 18, wherein there is provided a projection extending from and located at a tip of either or both of said pressure receiving portion and said second pressure receiving portion of each of said contacts, and said urging portions are pivotally movable between said pressure receiving portions and said second pressure receiving portions.

20. The connector as set forth in claim 19, wherein said second pressure receiving portion of each of said contacts is formed with a recess on the inner side of said projection so that said urging portion is pivotally movable in said recess and between said pressure receiving portion and said second pressure receiving portion.

21. The connector as set forth in claim 20, wherein when the connecting object has been inserted into said connector, each of said urging portions lies in said recess of said second pressure receiving portion of each of said contacts.

22. The connector as ser forth in claim 18, wherein said pressure receiving portion and said second receiving portion of each of said contacts are substantially in parallel with each other so that the urging portion of the pivoting member is pivotally movable between said pressure receiving portion and said second pressure receiving portion.

23. The connector as set forth in claim 22, wherein said second pressure receiving portion of each of said contacts is formed with a recess on the inner side of said projection so that said urging portion is pivotally movable in said recess and between said pressure receiving portion and said second pressure receiving portion.

24. The connector as set forth in claim 23, wherein when the connecting object has been inserted into said connector, each of said urging portions lies in said recess of said second pressure receiving portion of each of said contacts.

* * * * *